US011371111B2

(12) United States Patent
Zhang et al.

(10) Patent No.: US 11,371,111 B2
(45) Date of Patent: Jun. 28, 2022

(54) NON-ORIENTED ELECTRICAL STEEL SHEET WITH EXCELLENT MAGNETIC PROPERTIES AND MANUFACTURING METHOD THEREOF

(71) Applicant: BAOSHAN IRON & STEEL CO., LTD., Shanghai (CN)

(72) Inventors: Feng Zhang, Shanghai (CN); Xuejun Lv, Shanghai (CN); Bo Wang, Shanghai (CN); Baojun Liu, Shanghai (CN); Zhenyu Zong, Shanghai (CN); Kanyi Shen, Shanghai (CN); Yezhong Sun, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 109 days.

(21) Appl. No.: 16/759,787

(22) PCT Filed: Jul. 11, 2018

(86) PCT No.: PCT/CN2018/095237
§ 371 (c)(1),
(2) Date: Apr. 28, 2020

(87) PCT Pub. No.: WO2019/105041
PCT Pub. Date: Jun. 6, 2019

(65) Prior Publication Data

US 2021/0180147 A1 Jun. 17, 2021

(30) Foreign Application Priority Data

Nov. 30, 2017 (CN) ..... 201711241774.3

(51) Int. Cl.

| | |
|---|---|
| ***C21D 8/12*** | (2006.01) |
| ***C21D 6/00*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/16*** | (2006.01) |

(52) U.S. Cl.
CPC ..... *C21D 8/1261* (2013.01); *C21D 6/005* (2013.01); *C21D 6/008* (2013.01); *C21D 8/1233* (2013.01); *C21D 8/1272* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C22C 38/16* (2013.01)

(58) Field of Classification Search
None
See application file for complete search history.

(56) References Cited

U.S. PATENT DOCUMENTS 10,176,910 B2 * 1/2019 Xie ..... C21D 8/1261

FOREIGN PATENT DOCUMENTS

| | | | |
|---|---|---|---|
| CN | 100999050 | | 7/2007 |
| CN | 102041367 | | 5/2011 |
| CN | 102041367 | A | 5/2011 |
| CN | 102796947 | | 11/2012 |
| CN | 103509906 | A | 1/2014 |
| EP | 2821511 | A1 | 1/2015 |
| EP | 2821511 | A1 | 7/2015 |
| JP | H083686 | | 1/1996 |
| JP | 2004002954 | A | 1/2004 |
| JP | 2005179710 | | 7/2005 |
| KR | 10_20140115364 | | 8/2014 |
| KR | 20150048690 | A | 5/2015 |

OTHER PUBLICATIONS

KPO 1st Office Action.
JPO 1st Office Action.
SIPO 1st Office Action.
EPO Search Report for 18884597_8.
Lu & He paper, 12, 2006.
Office Action dated Mar. 5, 2021 for Indian Patent Application No. 202047014170.
International Search Report and Written Opinion dated Sep. 7, 2018 for PCT Patent Application No. PCT/CN2018/095237.

* cited by examiner

*Primary Examiner* — Daniel J. Schleis
(74) *Attorney, Agent, or Firm* — Lei Fang; Smith Tempel Blaha LLC

(57) ABSTRACT

Disclosed are a non-oriented electrical steel sheet with excellent magnetic properties and a manufacturing method thereof, wherein the mass percentage of the chemical components thereof are: C: 0-0.005%; Si: 2.1-3.2%, Mn: 0.2-1.0%, P: 0-0.2%, Al: 0.2-1.6%, N: 0-0.005%, Ti: 0-0.005%, Cu: 0-0.2%, and the balance of Fe and inevitable impurities; and at the same time, (the S content for forming MnS+the S content for forming CuxS)/the S content in the steel is required to be less than or equal to 0.2. The process for manufacturing the non-oriented electrical steel sheet of the present invention is simple and convenient, the chemical components of the steel are easy to control, the manufacturing process is stable, and the technical requirements are easy to realize.

7 Claims, No Drawings

NON-ORIENTED ELECTRICAL STEEL SHEET WITH EXCELLENT MAGNETIC PROPERTIES AND MANUFACTURING METHOD THEREOF

CROSS-REFERENCE TO RELATED APPLICATIONS

This application is a 371 U.S. National Phase of PCT International Application No. PCT/CN2018/095237 filed on Jul. 11, 2018, which claims benefit and priority to Chinese patent application no. 201711241774.3 filed on Nov. 30, 2017, which is incorporated by reference herein in its entirety.

TECHNICAL FIELD

The present invention relates to electrical steel sheets, in particular to a non-oriented electrical steel sheet with excellent magnetic properties and a manufacturing method thereof.

BACKGROUND ART

In recent years, with increasingly strict demand for high efficiency, energy saving and environmental protection in the user market, non-oriented silicon steel sheets used for manufacturing motors, compressors and EI iron core raw materials are required to have excellent electromagnetic properties (i.e., the so-called low iron loss and high magnetic induction) on the premise of ensuring a competitive advantage in price, so as to meet the urgent needs of these electric products for high efficiency, energy saving and environmental protection.

Previously, in order to obtain low iron loss and high magnetic induction, the following measures were often employed: conducting design optimization of chemical composition, adding special beneficial alloying elements to the steel, conducting hot-rolled sheet normalization treatment and increasing the temperature of continuous annealing. However, none of these measures takes into account the huge effect of fine precipitates in the steel on the electromagnetic properties of materials. For example, the addition of relatively high contents of Si and Al to steels can increase the electrical resistivity of materials, thereby reducing the iron loss of materials. For example, in the Japanese patent JP2015515539A, the content of Si is in the range of 2.5% to 4.0% and the content of Al is in the range of 0.5% to 1.5%. Therefore, the iron loss of the material decreases rapidly as the contents of Si and Al increase. However, the magnetic induction of materials also decreases rapidly and abnormal conditions such as cold-rolled strips breakage are likely to occur.

In order to improve the rollability of cold rolling, Chinese patent CN104399749A discloses a method for preventing edge cracking and brittle fracture of a steel having a Si content of 3.5% or more, but even so, the rejection rate of brittle fracture is still 0.15% and the requirement on functional accuracy of the device is very high. Moreover, in Chinese patent CN103014503A, in order to obtain a good magnetic induction of material, 0.20% to 0.45% of (Sn +Cu) is added to the steel and the texture morphology of material is improved by utilizing grain boundary segregation, thereby obtaining a good magnetic induction of material. However, Sn and Cu are expensive metals, which will greatly increase the manufacturing cost. Cu also easily causes quality defects on the surface of the strip steel.

In Japanese laid-open Patent Publication No. 10-25554, the magnetic induction of material is improved by increasing the ratio of Al/(Si +Al) on the premise that the total amount of Si and Al remains unchanged. However, as the content of Al increases and the content of Si decreases, the iron loss of material deteriorates and the mechanical properties of material also decrease.

Nowadays, normalization treatment or intermediate annealing in a bell-type furnace is an effective method to improve the iron loss and magnetic induction of material and is widely used in the production of high-efficiency, high-grade non-oriented silicon steel sheets, which can effectively reduce the iron loss of material and greatly improve the magnetic induction of material. However, such method needs introducing new production equipment, which greatly increases manufacturing costs and extends the manufacturing and delivery cycle of material, thereby bringing new troubles to the technical and quality management in the production field.

Given the above issue, technicians start the following studies: strong deoxidizing and desulfurizing elements such as rare earth elements and calcium alloy elements are added to the steel under the condition of relatively fixed chemical composition to effectively remove or reduce non-metallic inclusions, thereby enhancing the electromagnetic properties of material by improving the cleanliness of the steel; or rough rolling passes with high reduction, rough roll rolling and high temperature coiling can be used to obtain a high-grade non-oriented electrical steel with high magnetic induction; or the combination of hot rolling temper rolling function with normalizing annealing treatment can also be used to obtain a non-oriented silicon steel with high magnetic induction.

Furthermore, the fine precipitates in the steel have an effect on the grain growth of the finished strip steel during continuous annealing. In particular, the effect of fine sulfides on the grain size can cause a significant increase in iron loss in the finished strip steel. From the perspective of harmlessness, it is necessary to reduce the quantity of sulfides in the steel as much as possible and ensure that they keep coarse. Reducing the quantity of sulfides is closely related to reducing the content of sulfur, which requires deep desulfurization in RH refining and the improvement of desulfurization efficiency by prolonging the degassing time of RH refining, but this will inevitably increase the manufacturing cost of steel.

In addition, a method of reducing heating temperature of hot rolling has been proposed. For example, the temperature of rough rolling passes during hot rolling is limited to between 950° C. and 1150° C. to prevent precipitation of fine MnS. However, it is very difficult to limit the type and status of sulfides in the steel to a specific range by simply reducing heating temperature of hot rolling. Moreover, the reduction of heating temperature of hot rolling will also lead to an increase in the hot rolling load, which is very unfavorable to the recrystallization and growth in grain size after hot rolling.

SUMMARY OF THE INVENTION

The object of the present invention is to provide a non-oriented electrical steel sheet with excellent magnetic properties and a manufacturing method thereof. The non-oriented electrical steel sheet has excellent magnetic properties and an iron loss ($P_{15/50}$) of no more than 2.4 W/kg. Moreover, the manufacturing process is simple and convenient, and it is easy to control the chemical composition of the steel, and the manufacturing process is stable and it is easy to satisfy the technical requirements.

To achieve the above object, the technical solutions of the present invention are as follows.

A non-oriented electrical steel sheet with excellent magnetic properties, comprising the following chemical composition in percentage by mass: C: 0-0.005%, Si: 2.1-3.2%, Mn: 0.2-1.0%, P: 0-0.2%, Al: 0.2-1.6%, N: 0-0.005%, Ti: 0-0.005%, Cu: 0-0.2%, with the balance being Fe and inevitable impurities; and the steel sheet meets the following Formula (1):

(the S content for forming MnS +the S content for forming $Cu_xS$)/the S content in the steel ≤0.2 Formula (1).

Furthermore, the number of formed MnS having a size in the range of 0.2 μm to 0.5 μm is $5.0\times10^8$ /mm$^3$ or less, and in the case of the size of the formed MnS being in the range of 0.2 μm to 1.0 μm, the steel sheet meets the following Formula (2):

the number of MnS inclusions having a size in the range of 0.5 μm to 1.0 μm/the number of MnS inclusions having a size in the range of 0.2 μm to 0.5 μm <0.2 Formula (2).

The iron loss ($P_{15/50}$ of the non-oriented electrical steel sheet according to the present invention is not more than 2.4 W/kg.

The composition of the non-oriented electrical steel sheet with excellent magnetic properties according to the present invention is designed as follows:

Carbon (C): C strongly hinders the grain growth of the finished steel and easily forms fine precipitates in combination with Nb, V, Ti, etc., thereby causing an increase in loss and generation of magnetic aging. Therefore, it is necessary to control the C content to 0-0.005%.

Silicon (Si): Si can significantly increase the electrical resistivity of the finished steel and effectively reduce the loss of the finished steel. When the Si content is higher than 3.2%, the magnetic induction of the finished steel will be significantly reduced; and when the Si content is lower than 2.1%, a remarkable reduction of the loss will not be achieved. Therefore, the Si content of the present invention is controlled to 2.1-3.2%.

Manganese (Mn): Mn combines with S to form MnS, which can reduce the harm to the magnetic properties of the finished steel and improve the surface quality of the finished steel. Therefore, it is necessary to add Mn in a content of 0.2% or more. However, when the Mn content is higher than 1.0%, it will cause casting difficulties in continuous casting and the recrystallization texture of the finished steel will be easily damaged. Therefore, the Mn content of the present invention is controlled to 0.2-1.0%.

Phosphorus (P): when the P content is more than 0.2%, a phenomenon of cold brittleness is likely to occur, which reduces the manufacturability of cold rolling unit. Therefore, the P content of the present invention is controlled to 0.2% or less.

Aluminum (Al): Al can significantly increase the electrical resistivity of the finished steel and is used for deep deoxidation of the liquid steel at the same time. Therefore, it is necessary to add Al in a content of 0.2% or more. However, when the Al content is higher than 1.6%, the magnetic induction of the finished steel will be significantly reduced and at the same time the manufacturing cost of steelmaking will be greatly increased. Therefore, the Al content of the present invention is controlled to 0.2-1.6%.

Nitrogen (N): when the N content is more than 0.005%, precipitates formed from N and Nb, V, Ti, Al, etc. will be greatly increased, which will strongly hinder the grain growth of the finished steel and deteriorate the magnetic properties of the finished steel. Therefore, the N content of the present invention is controlled to 0.005% or less.

Titanium (Ti): when the Ti content is more than 0.005%, the inclusions of titanium carbide and titanium nitride will be greatly increased, which will strongly hinder the grain growth of the finished steel and deteriorate the magnetic properties of the finished steel. Therefore, the Ti content of the present invention is controlled to 0-0.005%.

Copper (Cu): Cu combines with S to form $Cu_xS$, which degrades the magnetic properties of the finished steel. When the Cu content is more than 0.2%, it is easy to cause quality defects on the surface of the hot rolled sheet. Therefore, the Cu content of the present invention is controlled to 0-0.2%.

The non-oriented electrical steel sheet with excellent magnetic properties according to the present invention and a manufacturing method thereof, comprising the following steps:

1) performing hot metal pretreatment of blast furnace hot metal for desulfurization, demanganization and removal of slag;

2) adding scrap steel and then conducting converter smelting;

3) conducting RH vacuum cycle degassing refining, which comprises:

a) conducting deep decarburization to control the carbon content of liquid steel to 0.005% or less;

b) conducting deoxidation and alloying treatment;

c) optimizing the chemical composition of liquid steel, wherein, the mass percentage of each element of the chemical composition in the liquid steel is as follows: C: 0-0.005%, Si: 2.1-3.2%, Mn: 0.2-1.0%, P: 0-0.2%, Al: 0.2-1.6%, N: 0-0.005%, Ti: 0-0.005%, Cu: 0-0.2%, with the balance being Fe and inevitable impurities;

d) refining and degassing;

4) casting the liquid steel to form a slab, wherein in the casting process, the cooling rate is controlled to be 2.5-25° C/min during a cooling process in which the surface temperature of the slab is lowered from 1100° C. to 700° C.;

5) hot rolling;

6) pickling;

7) cold rolling;

8) annealing;

9) coating.

Preferably, in the casting process of step 4), the cooling rate is controlled to be 2.5-20° C./min during the cooling process in which the surface temperature of the slab is reduced from 1100° C. to 700° C.

Preferably, in the hot rolling of step 5), the rate of cooling a strip steel during a finishing rolling is not more than 20° C./s, the time from the end of the finishing rolling to the start of a water-cooling is not less than 5 s, and coiling temperature is not lower than 600° C., preferably not lower than 700° C.

In the present invention of the non-oriented electrical steel, the raw materials are subjected to hot metal pretreatment for desulfurization, demanganization and removal of slag, then an appropriate proportion of scrap steel is added for converter smelting. During the smelting process, it is ensured that the slagging condition is good and the decarburization and heating effects of the liquid steel are stable.

The liquid steel after being smelted in the converter is firstly subjected to deep decarburization in the RH refining (vacuum cycle degassing refining) process. After the decarburization is completed, the carbon content of the liquid steel is controlled to 0.005% or less. Then, the liquid steel is subjected to deoxidization and alloying by adding silicon and copper.

From the perspective of composition design, since elements Si and Al can significantly improve the electrical resistivity of material, effectively reduce the magnetocrystalline anisotropy, make it easier for material to magnetize, and are the most effective elements to improve the magnetic properties of the non-oriented electrical steel sheet, adding an appropriate amount of Si element to the steel not only improves the magnetic properties of the steel but also reduces the iron loss of the steel as compared to the prior arts ; and a proper amount of Al element also plays the role of deep deoxidation of the steel while increasing the electrical resistivity.

The key of the present invention is how to effectively control the morphology and quantity of sulfides in the steel because this is directly related to the electromagnetic properties of the corresponding finished strip steel. Studies have shown that inclusions in the steel, especially finely dispersed inclusions, can significantly affect the microstructure of the hot-rolled sheets and finished steel sheets, and finely dispersed inclusions can significantly hinder the growth of grains, making the grain size of the finished products fail to meet the optimal grain size, which causes the magnetic hysteresis loss to increase. Therefore, the number and size of inclusions in the steel must be effectively controlled. On the other hand, experience has shown that the damage degree to magnetic properties caused by finely dispersed inclusions with acicular shape is larger than that caused by finely dispersed inclusions with strip shape, and the damage degree to magnetic properties caused by finely dispersed inclusions with dendritic shape is larger than that caused by finely dispersed inclusions with spherical shape.

Based on this, it is found that under the condition of harmful size of specific inclusions, the quantity of oxides and nitrides is very small and the majority are sulfur-containing inclusions such as MnS and $Cu_xS$ during the process of casting and solidification of liquid steel. In addition, due to the difference in the control of chemical composition in steel, the design of the continuous casting cooling system, and the great difference in precipitation conditions of MnS and $Cu_xS$ inclusions including their morphology and sizes during the controlling process of hot rolling temperature, the various inclusions formed thereafter have quite different effects on magnetic properties. For example, inclusions which have a size close to the domain wall size in a scale of hundreds of nanometers are preferentially formed during the cooling of the slab and have a size of about 0.5-1.0 μm and a shape of elliptical or nearly spherical, and have a relatively small effect on magnetic properties of the finished strip steel. However, inclusions in the range of 0.2-0.5 μm, e.g. $Cu_2S$ inclusion, are mainly generated in the late stage of hot rolling. As the number of inclusions increases, the magnetic properties of the finished product deteriorate significantly.

Besides, generally, element S in steel can be combined with elements such as Mn, Cu, Ca and Mg, and depending on the hot rolling conditions, single or composite inclusions are formed. The method used for analysis and test of sulfides is non-aqueous solution electrolytic extraction plus scanning electron microscope observation. In this method, inclusions with a size of 1 μm or more are observed at a magnification of 1000 times, inclusions with a size of 0.5-1.0 μm are observed at a magnification of 5000 times, and inclusions with a size of 0.2-0.5 μm are observed at a magnification of 10000 times. By counting the size, type, number, and distribution of inclusions in a certain number of fields of view, information such as regularities of distribution and existential state of inclusions in the steel is obtained.

Studies have shown that different types of sulfides have different solid solution and precipitation temperatures. During the processes of hot rolling and heat treatment, the main factors affecting the development of crystal texture and grain size growth are MnS and $Cu_xS$, the sizes and ratios of which in the steel have a direct impact on the recrystallization effect. The ideal control effects and technical requirements are:

(the S content for forming MnS +the S content for forming $Cu_xS$)/the S content in the steel ≤0.2 Formula (1).

Furthermore, the number of formed MnS having a size in the range of 0.2 μm to 0.5 μm is $5.0\times10^8/mm^3$ or less, and in the case of the size of the formed MnS being in the range of 0.2 μm to 1.0 μm, the following relationship must be met:

the number of MnS inclusions having a size in the range of 0.5 μm to 1.0 μm/the number of MnS inclusions having a size in the range of 0.2 μm to 0.5 μm≤0.2 Formula (2).

The hot rolling process is very important for the control of precipitation of sulfides. In particular, if the slab is heated at 900-1100° C. and soaked for 30 minutes before the hot rolling, the effect will be more obvious. The higher the temperature and the longer the time during the high-temperature stage, the more the solid solution of the sulfide, the smaller the precipitated inclusions and the greater the number of precipitated inclusions during the cooling stage. On the other hand, if the heating temperature of the slab is relatively low, the corresponding final rolling and coiling temperatures will be lower, which will have a certain inhibitory effect on the formation of sulfides, but will also affect the growth of the hot-rolled recrystallized structure.

A suitable hot rolling method is to control the temperature, time, history and cooling rate during the hot rolling process. For a composition system with no more than 0.2% of Cu, the slab can be heated at 900-1100° C. and soaked for no less than 30 minutes in advance to ensure uniform temperature, and then heated to 1150° C. or higher for short-term high temperature heating to ensure that the slab affects the growth of the hot rolling recrystallized structure in the rolling process due to the reduction of the surface temperature. In this way, the type, number and size of precipitation of sulfides can be controlled by controlling the finishing rolling temperature and cooling rate of strip steel in the hot rolling process.

Furthermore, since the temperature required for the formation of Cu-containing sulfides is very low, the cooling rate of the strip steel during the finishing rolling process is preferably not more than 20° C./s, the time from the end of finishing rolling to the water-cooling opening is not less than 5s, and the coiling temperature is not lower than 600° C., preferably not lower than 700° C. Therefore, the purpose of controlling the morphology and quantity of Cu-containing sulfides can be achieved.

The present invention refers to a non-oriented electrical steel sheet with high magnetic induction, low iron loss and relatively low manufacturing cost without undergoing normalization treatment or intermediate annealing in a bell furnace, and a manufacturing method thereof.

DETAILED DESCRIPTION

The present invention will be further described with reference to the following Examples.

Table 1 shows chemical compositions of electrical steel sheets of Examples and Comparative Examples of the present invention. Table 2 shows the process design and electromagnetic properties of Examples and Comparative Examples of the present invention.

Hot metal and scrap steel were proportioned according to the chemical composition ratios in Table 1. After smelting in a 300-ton converter, decarburization, deoxidation and alloying were carried out in RH refining process. The Mn and Cu contents were dynamically adjusted according to the content of S in the steel, and the C, N, Ti and Al contents were controlled to meet the design requirements. The liquid steel was subjected to continuous casting to obtain a slab with a thickness of 170 mm-250 mm and a width of 800 mm-1400 mm, then the slab was sequentially subjected to hot rolling, pickling, cold rolling, annealing, and coating to obtain the final product. The process parameters and electromagnetic properties are shown in Table 2. During hot rolling, the slab was fully soaked at 1100° C. and heated to 1150° C. by short-term surface heating. During the process of hot rolling, the cooling rate and time of final rolling and coiling were strictly controlled to ensure the coiling temperature is not less than 700° C., so as to obtain suitable S content for forming Mn and Cu sulfides, and MnS contents in different ranges of size.

TABLE 1

(unit: mass %)

| | C | Si | Mn | P | Al | Ti | N | Cu |
|---|---|---|---|---|---|---|---|---|
| Comparative Example 1 | 0.0009 | 2.11 | 0.27 | 0.012 | 0.46 | 0.0014 | 0.0008 | 0.004 |
| Comparative Example 2 | 0.0008 | 2.78 | 1.13 | 0.09 | 1.12 | 0.0022 | 0.0041 | 0.021 |
| Comparative Example 3 | 0.0059 | 3.05 | 0.53 | 0.15 | 0.52 | 0.0013 | 0.0012 | 0.008 |
| Comparative Example 4 | 0.0032 | 2.91 | 0.99 | 0.29 | 0.68 | 0.0004 | 0.0015 | 0.019 |
| Comparative Example 5 | 0.0019 | 3.36 | 0.48 | 0.09 | 0.45 | 0.0029 | 0.0029 | 0.006 |
| Comparative Example 6 | 0.0028 | 3.24 | 0.81 | 0.034 | 0.94 | 0.0008 | 0.0008 | 0.012 |
| Example 1 | 0.0013 | 2.62 | 0.92 | 0.024 | 0.32 | 0.0006 | 0.0018 | 0.008 |
| Example 2 | 0.0007 | 2.62 | 0.45 | 0.11 | 0.94 | 0.0013 | 0.0009 | 0.011 |
| Example 3 | 0.0019 | 2.81 | 0.58 | 0.016 | 1.31 | 0.0006 | 0.0014 | 0.006 |
| Example 4 | 0.0048 | 2.94 | 0.43 | 0.011 | 0.82 | 0.0015 | 0.0011 | 0.009 |
| Example 5 | 0.0027 | 2.92 | 0.27 | 0.09 | 1.46 | 0.0004 | 0.0012 | 0.019 |
| Example 6 | 0.0009 | 2.98 | 0.65 | 0.14 | 0.58 | 0.0009 | 0.0019 | 0.018 |
| Example 7 | 0.0022 | 3.16 | 0.70 | 0.15 | 0.74 | 0.0008 | 0.0019 | 0.013 |
| Example 8 | 0.0031 | 3.15 | 0.54 | 0.05 | 1.02 | 0.0002 | 0.0012 | 0.011 |
| Example 9 | 0.0019 | 3.17 | 0.48 | 0.19 | 0.51 | 0.008 | 0.0008 | 0.012 |
| Example 10 | 0.0041 | 3.09 | 0.51 | 0.07 | 0.69 | 0.0026 | 0.0007 | 0.017 |
| Example 11 | 0.0032 | 3.16 | 0.36 | 0.15 | 0.49 | 0.0011 | 0.0016 | 0.007 |

TABLE 2

| | S content (%) [MnS] | S content (%) [$Cu_xS$] | S content (%) | the number of MnS ($10^8$) 0.2-0.5 μm | the number of MnS ($10^7$) 0.5-1.0 μm | E1 | E2 | cooling rate of finishing rolling (° C./min) | air cooling time from final rolling to coiling (s) | coiling temperature ° C. | iron loss $P_{15/50}$ (W/kg) |
|---|---|---|---|---|---|---|---|---|---|---|---|
| Comparative Example 1 | 0.0004 | 0.0003 | 0.0041 | 3.1 | 2.9 | 0.17 | 0.09 | 4.1 | 8.4 | 563 | 3.42 |
| Comparative Example 2 | 0.0004 | 0.0005 | 0.0011 | 2.2 | 5.5 | 0.82 | 0.25 | 8.9 | 20.6 | 732 | 3.61 |
| Comparative Example 3 | 0.0002 | 0.0001 | 0.0018 | 8.6 | 6.5 | 0.17 | 0.08 | 20.5 | 4.1 | 655 | 3.24 |
| Comparative Example 4 | 0.0001 | 0.0001 | 0.0024 | 1.6 | 1.4 | 0.08 | 0.09 | 15.9 | 16.3 | 575 | 2.99 |
| Comparative Example 5 | 0.0004 | 0.0002 | 0.0032 | 2.9 | 6.5 | 0.19 | 0.22 | 26.2 | 7.4 | 721 | 2.52 |
| Comparative Example 6 | 0.0002 | 0.0003 | 0.0009 | 6.4 | 4.1 | 0.56 | 0.06 | 12.8 | 11.2 | 692 | 2.48 |
| Example 1 | 0.0005 | 0.0001 | 0.0038 | 1.7 | 2.1 | 0.16 | 0.12 | 7.2 | 5.3 | 651 | 2.28 |
| Example 2 | 0.0002 | 0.0003 | 0.0029 | 4.8 | 4.1 | 0.17 | 0.09 | 11.6 | 6.8 | 752 | 2.22 |
| Example 3 | 0.0001 | 0.0002 | 0.0017 | 2.9 | 5.2 | 0.17 | 0.18 | 18.2 | 11.4 | 711 | 2.04 |
| Example 4 | 0.0002 | 0.0002 | 0.0022 | 2.2 | 1.6 | 0.18 | 0.07 | 3.7 | 10.5 | 683 | 2.12 |
| Example 5 | 0.0001 | 0.0001 | 0.0014 | 4.1 | 8.1 | 0.14 | 0.20 | 6.5 | 9.1 | 702 | 2.03 |
| Example 6 | 0.0001 | 0.0005 | 0.003 | 3.6 | 3.2 | 0.20 | 0.09 | 19.1 | 20.4 | 622 | 2.05 |
| Example 7 | 0.0004 | 0.0001 | 0.0027 | 0.9 | 1.2 | 0.19 | 0.13 | 11.1 | 18.3 | 705 | 2.15 |
| Example 8 | 0.0005 | 0.0003 | 0.0045 | 1.9 | 2.2 | 0.18 | 0.12 | 4.2 | 7.9 | 689 | 1.91 |
| Example 9 | 0.0001 | 0.0001 | 0.0017 | 2.4 | 0.9 | 0.12 | 0.04 | 15.8 | 12.4 | 671 | 2.00 |
| Example 10 | 0.0001 | 0.0001 | 0.0012 | 3.2 | 6.4 | 0.17 | 0.20 | 11.2 | 15.3 | 688 | 1.98 |
| Example 11 | 0.0001 | 0.0002 | 0.0015 | 5.0 | 8.4 | 0.20 | 0.17 | 7.6 | 8.2 | 740 | 2.02 |

Notes:

E1: (the S content for forming MnS + the S content for forming $Cu_xS$);

E2: the number of MnS in the range of 0.2 μm to 0.5 μm/ the number of MnS in the range of 0.5 μm to 1.0 μm.

The invention claimed is:

1. A non-oriented electrical steel sheet with excellent magnetic properties, comprising the following chemical composition in percentage by mass: $0<C\leq0.005\%$, Si: 2.1-3.2%, Mn: 0.2-1.0%, $0<P\leq0.2\%$, Al: 0.2-1.6%, N: 0-0.005%, Ti: 0-0.005%, $0<Cu\leq0.2\%$, with the balance being Fe and inevitable impurities; and the steel sheet meets the following Formula (1):

(the S content of the forming MnS+the S content of the forming $Cu_xS$)/the S content in the steel≤0.2.

2. The non-oriented electrical steel sheet with excellent magnetic properties as claimed in claim 1, wherein the number of formed MnS having a size in the range of 0.2 μm to 0.5 μm is $5.0\times10^8$ /mm$^3$ or less, and in the case of the size of the formed MnS being in the range of 0.2 μm to 1.0 μm, the steel sheet meets the following Formula (2):

(the number of MnS inclusions having a size in the range of 0.5 μm to 1.0 μm)/(the number of MnS inclusions having a size in the range of 0.2 μm to 0.5 μm)≤0.2.

3. The non-oriented electrical steel sheet with excellent magnetic properties as claimed in claim 1, wherein iron loss ($Pi_{15/50}$) of the non-oriented electrical steel sheet is not more than 2.4 W/kg.

4. A manufacturing method of the non-oriented electrical steel sheet with excellent magnetic properties as claimed in claim 1, comprising the following steps:

1) performing hot metal pretreatment of blast furnace hot metal for desulfurization, demanganization and removal of slag;
2) adding scrap steel and then conducting converter smelting;
3) conducting RH vacuum cycle degassing refining, which comprises:
   a) conducting deep decarburization to control the carbon content of liquid steel to 0.005% or less;
   b) conducting deoxidation and alloying treatment;
   c) optimizing the chemical composition of liquid steel, wherein the mass percentage of each element of the chemical composition in the liquid steel is as follows: $0<C\leq0.005\%$, Si: 2.1-3.2%, Mn: 0.2-1.0%, $0<P\leq0.2\%$, Al: 0.2-1.6%, N: 0-0.005%, Ti: 0-0.005%, $0<Cu\leq0.2\%$, with the balance being Fe and inevitable impurities;
   d) refining and degassing;
4) casting the liquid steel to form a slab, wherein in the casting process, the cooling rate is controlled to be 2.5-25° C./min during a cooling process in which the surface temperature of the slab is lowered from 1100° C. to 700° C.;
5) hot rolling;
6) pickling;
7) cold rolling;
8) annealing; and
9) coating.

5. The manufacturing method of the non-oriented electrical steel sheet with excellent magnetic properties as claimed in claim 4, wherein in the casting process of step 4), the cooling rate is controlled to be 2.5-20° C./min during the cooling process in which the surface temperature of the slab is reduced from 1100° C. to 700° C.

6. The manufacturing method of the non-oriented electrical steel sheet with excellent magnetic properties as claimed in claim 4, wherein in the hot rolling of step 5), the rate of cooling a strip steel during a finishing rolling is not more than 20° C./s, the time from the end of the finishing rolling to the start of a water-cooling is not less than 5s, and coiling temperature is not lower than 600° C.

7. The manufacturing method of the non-oriented electrical steel sheet with excellent magnetic properties as claimed in claim 6, wherein in the hot rolling of step 5), the coiling temperature is not lower than 700° C.

* * * * *